US010738729B2

(12) United States Patent
van den Heuvel et al.

(10) Patent No.: US 10,738,729 B2
(45) Date of Patent: Aug. 11, 2020

(54) DIRECT-INJECTION INTERNAL COMBUSTION ENGINE WITH TWO VALVES PER CYLINDER

(71) Applicant: Ford Global Technologies, LLC, Dearborn, MI (US)

(72) Inventors: Bas van den Heuvel, Wijnandsrade (NL); Wilbert Hemink, Landgraaf (NL); Klaus-Peter Heinig, Aachen (DE); Anselm Hopf, Baesweiler (DE); Joerg Bonse, Wuerselen (DE)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 16/432,869

(22) Filed: Jun. 5, 2019

(65) Prior Publication Data

US 2019/0376464 A1 Dec. 12, 2019

(30) Foreign Application Priority Data

Jun. 6, 2018 (DE) ..... 10 2018 208 891

(51) Int. Cl.

| | |
|---|---|
| ***F02B 75/20*** | (2006.01) |
| ***F02M 35/112*** | (2006.01) |
| ***F02F 1/24*** | (2006.01) |
| ***F02B 73/00*** | (2006.01) |
| ***F02B 63/04*** | (2006.01) |
| ***F01N 13/10*** | (2010.01) |
| ***F02F 1/42*** | (2006.01) |

(52) U.S. Cl.

CPC ..... *F02F 1/243* (2013.01); *F01N 13/10* (2013.01); *F02B 63/042* (2013.01); *F02B 73/00* (2013.01); *F02B 75/20* (2013.01); *F02F 1/4285* (2013.01); *F02M 35/112* (2013.01)

(58) Field of Classification Search

CPC ..... F02M 35/112; F02M 35/10072; F02M 35/10; F02M 35/10052; F02M 35/10078; F02M 35/104

See application file for complete search history.

(56) References Cited

U.S. PATENT DOCUMENTS

| | | | | |
|---|---|---|---|---|
| 4,428,340 A | | 1/1984 | Nikly | |
| 4,466,404 A | * | 8/1984 | Ueno | F02D 17/02 123/198 F |
| 5,085,178 A | * | 2/1992 | Hitomi | F02M 35/116 123/184.31 |

(Continued)

FOREIGN PATENT DOCUMENTS

| | | | |
|---|---|---|---|
| DE | 102013019473 | A1 | 5/2015 |
| DE | 102014208723 | A1 | 11/2015 |

(Continued)

*Primary Examiner* — Long T Tran

(74) *Attorney, Agent, or Firm* — Gregory Brumbaugh; McCoy Russell LLP

(57) ABSTRACT

An engine line is described herein that includes a first engine including a front end accessory drive system and a second engine including a greater number of cylinders than the first engine and a front end accessory drive system. The engine line further includes a generator, in different manufacturing arrangements, mounting to each of the front engine accessory drive systems in the first and second engines in a common location.

20 Claims, 6 Drawing Sheets

(56) References Cited

U.S. PATENT DOCUMENTS

| | | | | |
|---|---|---|---|---|
| 5,829,401 | A * | 11/1998 | Masuda | F01M 3/02 123/179.25 |
| 5,970,946 | A | 10/1999 | Shea et al. | |
| 6,125,827 | A * | 10/2000 | Wada | F02B 61/045 123/516 |
| 6,189,637 | B1 * | 2/2001 | Tosaka | F01L 1/024 180/219 |
| 2007/0175432 | A1 * | 8/2007 | Yakabe | F02B 27/0252 123/184.57 |
| 2013/0197783 | A1 * | 8/2013 | Kato | F02D 41/1454 701/103 |
| 2013/0255630 | A1 * | 10/2013 | Aso | F02D 41/0087 123/445 |
| 2015/0226159 | A1 * | 8/2015 | Jayakar | F02M 26/01 60/278 |
| 2017/0008527 | A1 * | 1/2017 | Nishida | B60W 30/18072 |
| 2017/0276095 | A1 * | 9/2017 | Beyer | F02M 26/30 |
| 2018/0171889 | A1 * | 6/2018 | Fiveland | F02D 41/0027 |
| 2018/0266372 | A1 * | 9/2018 | Schallauer | B29C 65/06 |

FOREIGN PATENT DOCUMENTS

| | | | |
|---|---|---|---|
| JP | S6098123 | A | 6/1985 |
| WO | 2012016659 | A1 | 2/2012 |

* cited by examiner

DIRECT-INJECTION INTERNAL COMBUSTION ENGINE WITH TWO VALVES PER CYLINDER

CROSS REFERENCE TO RELATED APPLICATIONS

The present application claims priority to German patent application No. 102018208891.8, filed on Jun. 6, 2018. The entire contents of the above-listed application are hereby incorporated by reference for all purposes.

FIELD

The present description relates to an engine and engine line.

BACKGROUND/SUMMARY

According to some prior art engine intake systems, the intake lines which lead to the inlet openings and the exhaust-gas lines which adjoin the outlet openings are at least partially integrated in the cylinder head, and are generally merged in each case so as to form at least one manifold.

In the case of the internal combustion engine to which the present description relates, the intake lines are merged to form an overall intake line, thus forming an intake manifold.

In general, the exhaust-gas lines of the cylinders are merged within the cylinder head so as to form an integrated exhaust manifold, that is to say the exhaust manifold is integrated e.g., entirely integrated) in the cylinder head. A cylinder head of said type is also characterized by a very compact design, which permits dense packaging of the drive unit as a whole. Furthermore, said exhaust manifold can benefit from a liquid-type cooling arrangement that may be provided in the cylinder head, such that the manifold does not need to be manufactured from thermally highly loadable and thus expensive materials, if desired.

The use of a cylinder head with an integrated manifold also leads to a reduced number of components, and consequently to a reduction in costs, in particular assembly and procurement costs.

The cylinder head of a modern internal combustion engine is generally thermally more highly loaded and therefore also places increased demands on the cooling arrangement, in particular if the cylinder head is equipped with an integrated exhaust manifold and/or the internal combustion engine is a supercharged internal combustion engine.

If the internal combustion engine has a liquid cooling arrangement, at least one coolant jacket is formed in the cylinder head, which coolant jacket conducts the coolant through the cylinder head; this necessitates a relatively complex cylinder head structure.

The above statements make it clear that the cylinder head of an internal combustion engine is a thermally and mechanically highly loaded component. In this context, it may be taken into consideration that an increasing proportion of internal combustion engines are supercharged—by means of exhaust-gas turbocharger or mechanical charger. On account of the ever more dense packaging in the engine bay and the increasing integration of parts and components into the cylinder head, for example the integration of the exhaust manifold, the thermal loading of the internal combustion engine and of the cylinder head is increased in particular, such that increased demands are placed on the cooling system.

In the case of direct-injection internal combustion engines, it may also be desired for the injection device of each cylinder to be arranged in the cylinder head close to the combustion chamber. This poses problems in particular in the case of internal combustion engines with two valves per cylinder, in the case of which the inlet opening and the outlet opening should be designed to be as large as possible in order to realize a satisfactory charge exchange, that is to say in order to ensure both good charging of the cylinder and an effective discharge of the combustion gases.

According to the prior art, the constricted space conditions in the cylinder head have the effect that the injection nozzle is arranged eccentrically and so as to be inclined relative to the cylinder longitudinal axis. This arrangement of the injection nozzle impedes the most extensive and uniform possible distribution of the fuel in the combustion chamber. This may be highly detrimental to the mixture formation and homogenization of the fuel-air mixture.

Space efficiency component packaging is also desirable in some engines. However, space efficient component packaging may be at odds with certain efficient engine manufacturing procedures.

Against the background of that stated above, one example engine objective is to provide a direct-injection internal combustion engine which is distinguished by improved mixture formation and which provides a satisfactory power output. A compact engine arrangement may be another objective of the engines described herein.

The objectives may at least partially be achieved by means of a direct-injection internal combustion engine having a cylinder head comprising at least three cylinders in an in-line arrangement along a longitudinal axis of the cylinder head, in which internal combustion engine, each cylinder has an inlet opening for the supply of combustion air into the cylinder via an intake system, each inlet opening being adjoined by an intake line, and the intake lines of the cylinders merging to form an overall intake line, thus forming an intake manifold, each cylinder has an outlet opening for discharging the exhaust gases via an exhaust-gas discharge system, each outlet opening being adjoined by an exhaust-gas line, each inlet opening is equipped with an inlet valve, and each outlet opening is equipped with an outlet valve, each cylinder comprises a piston articulately connected to a crankshaft, which piston oscillates along a cylinder longitudinal axis as the crankshaft rotates about an axis of rotation, the cylinder longitudinal axis being perpendicular to the axis of rotation of the crankshaft, and each cylinder is equipped with an injection nozzle for the direct introduction of fuel into the cylinder, and which internal combustion engine is distinguished by the fact that the cylinder-specific injection nozzle is arranged centrally, without a spacing to the cylinder longitudinal axis, and is oriented along the cylinder longitudinal axis.

In one example, each cylinder of the internal combustion engine according to the description may be equipped with an injection nozzle which is arranged centrally, that is to say in the middle, in the cylinder, specifically without a spacing to the cylinder longitudinal axis. Furthermore, the injection nozzle is oriented along the cylinder longitudinal axis and thus in the direction of the piston crown. This arrangement of the injection nozzle ensures or permits an extensive and uniform distribution of the fuel in the combustion chamber, whereby the mixture formation in the cylinder is assisted, in particular the homogenization of the fuel-air mixture in the short time available.

The objective on which the engine is based is thus achieved, that is to say a direct-injection internal combustion engine is provided which is distinguished by improved mixture formation and which provides a satisfactory power output.

Further advantageous embodiments of the direct-injection internal combustion engine will be discussed in greater detail herein.

Embodiments of the direct-injection internal combustion engine may be advantageous in which the cylinder head comprises three or five cylinders in an in-line arrangement, the intake manifold being of asymmetrical design such that the overall intake line is arranged eccentrically with respect to the manifold.

In the present case, as an example, the cylinder head may have an intake manifold of asymmetrical design, in the case of which the overall intake line is arranged not in the center of the manifold but eccentrically. In this way, in the case of cylinder heads with three, four or five cylinders, the overall intake line can be arranged with an equal spacing to a front face side of the cylinder head. This offers advantages for example if a traction drive mechanism is provided on the front face side of the cylinder head and a generator that can be driven by said traction drive mechanism is to be arranged between the front face side and the overall intake line.

Regardless of the respective number of cylinders, it is then possible for a structurally identical generator to be used, which, in cylinder heads with different numbers of cylinders, is positioned and fastened at the same location and interlinked or connected with the rest of the structure surrounding the generator.

That which has been stated above applies for example to an engine family which comprises cylinder heads with three, four and five cylinders. In the case of cylinder heads with four cylinders, it would then be possible for the intake manifold to be of symmetrical form, such that the overall intake line is arranged centrally between the two inner cylinders, that is to say between the second and third cylinders. In the case of cylinder heads with three and five cylinders, the intake manifold would be of asymmetrical form, specifically such that the overall intake line is arranged eccentrically, but again between the second and third cylinders, wherein the cylinders are numbered consecutively starting from the front face side of the cylinder head; from one to three or from one to five.

The eccentric arrangement of the overall intake line, that is to say of the intake manifold of asymmetrical form according to the description, can also be utilized advantageously in conjunction with other parts of the internal combustion engine, in particular auxiliary assemblies, specifically whenever it is possible to benefit from the fact that the overall intake line is arranged in an unchanged manner between the second and third cylinders irrespective of the number of cylinders of the cylinder head. These may also include the high-pressure pump of a fuel direct-injection means and/or the compressor of an air-conditioning system, which can be installed in an unchanged manner irrespective of the number of cylinders as long as the generator is positioned at the same location. The compressor of a supercharging arrangement may likewise be mentioned in this context. In this way, common components can be used in an engine line to achieved reduced engine manufacturing costs if desired. Furthermore, the components in the engines in the line may also be space efficiently packaged due to the profile of the intake manifolds in the different engines in the engine family.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

The invention will be described in more detail below on the basis of exemplary embodiments and in accordance with the figures. In the figures:

FIGS. 1-6 are shown approximately to scale. However, other relative dimensions may be used, in other embodiments.

DETAILED DESCRIPTION

Figure 1:
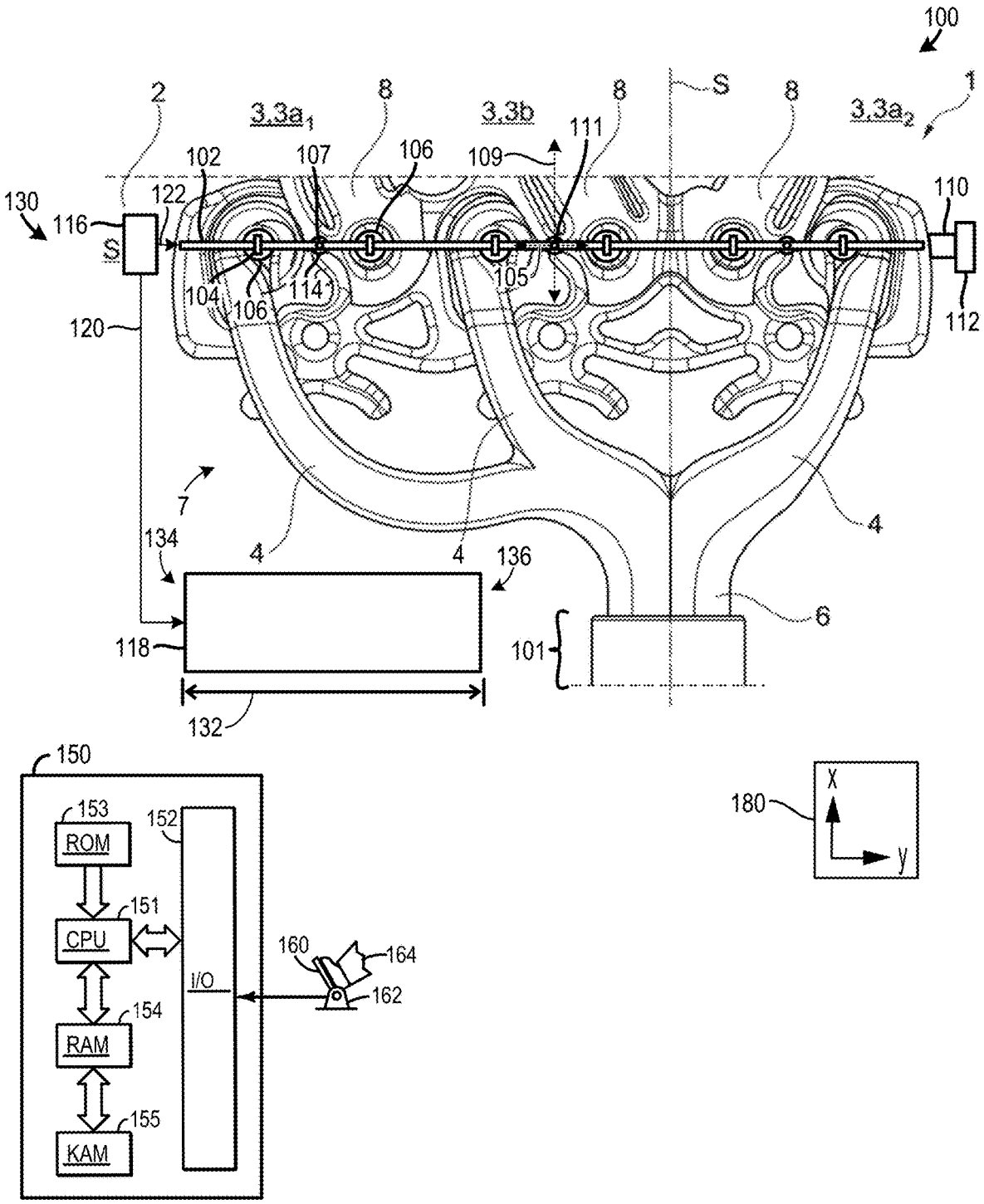
FIG. 1 shows, in plan view, the intake lines and the exhaust-gas lines of a first embodiment of a cylinder head, which comprises three cylinders, of the direct-injection internal combustion engine.

This description relates to a direct-injection internal combustion engine. In one example, the engine may have a cylinder head comprising at least three cylinders in an in-line arrangement along a longitudinal axis of the cylinder head, in which internal combustion engine. In the engine each cylinder has an inlet opening for the supply of combustion air into the cylinder via an intake system, each inlet opening being adjoined by an intake line, and the intake lines of the cylinders merging to form an overall intake line, thus forming an intake manifold. Additionally, in the engine, each cylinder may have an outlet opening for discharging the exhaust gases via an exhaust-gas discharge system, each outlet opening being adjoined by an exhaust-gas line. Additionally, in the engine, each inlet opening may be equipped with an inlet valve, and each outlet opening is equipped with an outlet valve. Furthermore, in the engine, each cylinder may comprise a piston articulately connected to a crankshaft, which piston oscillates along a cylinder longitudinal axis as the crankshaft rotates about an axis of rotation, the cylinder longitudinal axis being perpendicular to the axis of rotation of the crankshaft. Additionally, in the engine each cylinder may be equipped with an injection nozzle for the direct introduction of fuel into the cylinder.

An internal combustion engine of the abovementioned type is used for example as a drive for a motor vehicle.

Within the scope of the present description, the expression "internal combustion engine" encompasses auto-ignition diesel engines but also hybrid internal combustion engines, that is to say internal combustion engines which are operated by means of a hybrid combustion process with auto-ignition, and hybrid drives which, in addition to the auto-ignition internal combustion engine, comprise at least one further torque source for driving a motor vehicle, for example an electric machine which can be connected in terms of drive or is connected in terms of drive to the auto-ignition internal combustion engine and which outputs power instead of the internal combustion engine or in addition to the internal combustion engine.

Internal combustion engines according to the description may have a cylinder block and a cylinder head which are connected to one another to form the at least three cylinders or combustion chambers. To form a satisfactory connection, that is to say a connection which seals off the combustion chambers, between the cylinder head and cylinder block, an adequate number of adequately large bores may be provided, which influences and complicates the structural design in particular of the cylinder head.

The cylinder block, as the upper crankcase half, serves for accommodating the pistons and the cylinder liners of the cylinders. A crankshaft which is mounted in the crankcase absorbs the connecting rod forces and transforms the oscillating stroke movement of the pistons into a rotational movement of the crankshaft. To hold and mount the crankshaft, at least two bearings are provided in the crankcase.

The cylinder head generally may serve for accommodating the valve drives required for the charge exchange. To actuate a valve, it is commonly the case that a valve spring is provided in order to preload the valve in the direction of the valve closed position, and a valve actuating device is also provided in order to open the valve counter to the preload force of said valve spring.

Here, a valve actuating device generally comprises a camshaft with a cam, wherein overhead camshafts, i.e., camshafts which are situated above the parting plane between head and block, are commonly mounted on the cylinder head. As a further valve drive component, the valve actuating device may comprise a rocker lever, a finger-type rocker or a tappet as cam follower element.

During the course of the charge exchange, the discharge of the combustion gases via the exhaust-gas discharge system takes place via the outlet openings, and the supply of the combustion air via the intake system takes place via the inlet openings of the cylinders. According to the prior art, in four-stroke engines, for the control of the charge exchange, use is made virtually exclusively of lifting valves which are movable along their longitudinal axis between a valve closed position and a valve open position and which, during the operation of the internal combustion engine, perform an oscillating lifting movement in order to open up and shut off the inlet opening and outlet opening.

The actuating mechanism required for the valve, including the valve, is referred to as valve drive. In one example, it is the objective of the valve drive to open up and shut off the cylinder opening of the cylinder at the correct times, with a fast opening of the largest possible flow cross sections being sought in order to keep the throttling losses in the inflowing and outflowing gas flows low and in order to ensure the increased (e.g., the best possible) charging of the cylinder, and an effective (e.g., complete), discharge of the combustion gases.

For this reason, in some examples the cylinders of an internal combustion engine are commonly equipped with two or more inlet openings and two or more outlet openings.

The internal combustion engine to which the present description relates has only one inlet opening and only one outlet opening per cylinder, whereby the construction of the internal combustion engine is simplified, and the costs can be lowered, in one example. By contrast, the charge exchange, in particular the charging of the cylinder with combustion air, is impeded, for which reason problems are encountered in realizing a satisfactory power output. To improve the charge exchange, it is sought to design the inlet opening and the outlet opening to be as large as possible.

Cylinder openings of large design however generally make it difficult to achieve an advantageous central arrangement of the cylinder-specific injection nozzle. The internal combustion engine to which the present description relates is specifically a direct-injection internal combustion engine, in some instances.

There is relatively little time available for the injection of the fuel, the mixture preparation in the combustion chamber, specifically the thorough mixing of air and fuel and the preparation of the fuel in the context of preliminary reactions including the evaporation, and the ignition of the prepared mixture, for which reason, in the case of a direct injection of the fuel, methods for mixture formation are required with which the mixture formation is assisted and accelerated in order for the fuel-air mixture to be substantially homogenized prior to the ignition.

Good thorough mixing of the intake air with the injected fuel can be achieved if the inlet flow—as the air is drawn into the combustion chamber—has a movement forcibly imparted to it, whereby a charge movement is generated in the combustion chamber.

For example, the generation of a so-called tumble or swirling flow can accelerate and assist the mixture formation. A swirl is an air vortex whose axis runs parallel—and thus often coaxially—with respect to the piston longitudinal axis, that is to say cylinder longitudinal axis. By contrast, a tumble is an air vortex about an imaginary axis which runs transversely or perpendicularly with respect to the cylinder longitudinal axis and, according to the prior art, parallel to the longitudinal axis, that is to say to the axis of rotation of the crankshaft.

The arrangement and the geometry of the intake system, that is to say of the intake line, have a significant influence on the charge movement and thus on the mixture formation, wherein the charge movement in the cylinder is concomitantly influenced by the combustion chamber geometry, in particular by the geometry of the piston crown or of a piston depression that is optionally provided in the piston crown. According to the prior art, in the case of direct-injection internal combustion engines, use is generally made of depressions that are rotationally symmetrical to the piston longitudinal axis, in particular omega-shaped depressions. Owing to the constricted space conditions in the cylinder head, an optimization of the intake lines with regard to mixture formation and charge exchange may not be possible, or may not be fully possible.

Embodiments of the direct-injection internal combustion engine are advantageous in which the cylinder head has three cylinders, of which two cylinders are outer cylinders and one cylinder is an inner cylinder which is arranged between the two outer cylinders.

In the case of a three-cylinder in-line engine, the cylinders have, with respect to their working processes, an offset of 240° C.A, such that the charge exchanges, in particular the supply of combustion air, take place in succession, that is to say separately from one another, and possibly also with an overlap, which is then however small. An eccentric arrangement of the overall intake line, that is to say an asymmetrical form of the intake manifold, generally does not influence the charge exchange.

In this context, embodiments of the direct-injection internal combustion engine are advantageous in which, adjacent to a first outer cylinder, a traction drive mechanism is provided on a front face side of the cylinder head. For the distinction between the two outer cylinders, these two cylinders are numbered, and in the present case are referred to as first and second outer cylinders. The first outer cylinder is the first cylinder if the cylinders are numbered consecutively from one to three starting from the front face side of the cylinder head.

The traction drive mechanism may make use of belt drives and/or chain drives, some examples. As such, the belts and/or chains may be traction mechanisms. In general, a part of the power obtained in the internal combustion engine as a result of the chemical conversion of the fuel is utilized to drive the auxiliary assemblies required for the operation of the internal combustion engine or of the motor vehicle, in particular the injection pump, the oil pump, the coolant pump, the alternator or the generator and the like, or the camshaft, required for the control of a valve, of a valve drive.

A traction drive mechanism generally comprises, aside from the traction mechanism, a driving wheel arranged on the crankshaft of the internal combustion engine, and at least one further wheel, which is arranged on a shaft of an auxiliary assembly, wherein the traction mechanism is guided around the wheels. A tensioning device is commonly provided, which exerts force on the traction mechanism, engages into the traction mechanism so as to form a contact zone, and thus tensions the traction mechanism.

In the case of cylinder heads with three cylinders, embodiments are advantageous in which the intake lines of the cylinders merge to form the overall intake line centrally between the inner cylinder and an outer cylinder.

In the case of a cylinder head of the same engine family with four cylinders, it would then be possible for the intake manifold to be of symmetrical form, such that the overall intake line is arranged centrally between the two inner cylinders, that is to say between the second and third cylinders.

In this context, embodiments of the direct-injection internal combustion engine are therefore also advantageous in which the intake lines of the cylinders merge to form the overall intake line centrally between the inner cylinder and a second outer cylinder. The second outer cylinder is in the present case the third cylinder if the cylinders are numbered consecutively from one to three starting from the front face side of the cylinder head.

In the case of cylinder heads with three cylinders in which the intake lines of the cylinders merge to form the overall intake line centrally between the inner cylinder and an outer cylinder, embodiments are advantageous in which the intake lines of the inner cylinder and of the outer cylinder between which the overall intake line is arranged centrally are of symmetrical form, specifically with respect to a central plane S which runs centrally between the two cylinders and which is perpendicular to the longitudinal axis of the cylinder head.

In the case of a cylinder head of the same engine family with four cylinders, it would then be possible for the intake manifold to be of symmetrical form, such that the intake lines of the manifold are of symmetrical form with respect to a central plane S which is arranged centrally between the two inner cylinders, that is to say between the second and third cylinders.

In the case of cylinder heads which have three cylinders in an in-line arrangement, embodiments are advantageous in which firstly the intake line of a first outer cylinder and the intake line of the inner cylinder merge, before these jointly merge with the intake line of a second outer cylinder to form the overall intake line.

In the case of cylinder heads with three cylinders in which, adjacent to a first outer cylinder, a traction drive mechanism is provided on a front face side of the cylinder head, embodiments are advantageous in which a generator is provided between the front face side of the cylinder head and the overall intake line.

In the case of cylinder heads which have three cylinders in an in-line arrangement, embodiments are advantageous in this context in which firstly the intake line of a first outer cylinder and the intake line of the inner cylinder merge, before these jointly merge with the intake line of a second outer cylinder to form the overall intake line.

Embodiments of the direct-injection internal combustion engine may also be advantageous in which the cylinder head comprises four cylinders in an in-line arrangement and where the intake manifold has symmetric design such that the overall intake line is arranged centrally with respect to the manifold. Reference is made to the explanations that have already been given in conjunction with a four-cylinder in-line engine, in particular to the highlighted advantages that arise if the four-cylinder in-line engine belongs to an engine family (e.g., engine line). As described herein an engine line is a grouping of engines and components that may be used in engine production. Therefore, in one example, the engine line may be manufactured in a joint manufacturing facility. It will be understood that components that can be used in different engines in the lines may be advantageous from a manufacturing efficiency and cost perspective. For instance, if components such as a generator can be installed in two separate engines in a similar manner the cost of producing both the engines may be decreased by leveraging scaling efficiency gains.

Embodiments of the direct-injection internal combustion engine may also be advantageous in which the cylinder head comprises five cylinders, of which two cylinders are outer cylinders and one cylinder is a central cylinder, in each case one inner cylinder is arranged between the centrally situated cylinder and an outer cylinder.

In this context, embodiments of the direct-injection internal combustion engine are advantageous in which, adjacent to a first outer cylinder, a traction drive mechanism is provided on a front face side of the cylinder head.

In the case of cylinder heads which have five cylinders in an in-line arrangement, embodiments are advantageous in which the intake lines of the cylinders merge to form the overall intake line centrally between the central cylinder and an inner cylinder.

Embodiments of the direct-injection internal combustion engine are advantageous in particular in which the intake lines of the cylinders merge to form the overall intake line centrally between the central cylinder and an inner cylinder which is adjacent to a first outer cylinder. In the present case, the first outer cylinder is the first cylinder if the cylinders are numbered consecutively from one to five starting from the front face side of the cylinder head.

In this context, embodiments of the direct-injection internal combustion engine are advantageous in which the intake lines of the central cylinder and of the inner cylinder between which the overall intake line is arranged centrally are of symmetrical form, specifically with respect to a central plane S which runs centrally between the two cylinders and which is perpendicular to the longitudinal axis of the cylinder head.

Embodiments of the direct-injection internal combustion engine are advantageous in which the intake lines merge to form an overall intake line within the cylinder head.

The intake lines of the cylinders then merge to form an overall intake line in such a way as to form an intake manifold that is integrated in the cylinder head. This measure leads to a small volume and a small surface area of the intake system in the region of the intake manifold, with the advantages mentioned above. Furthermore, assembly is simplified, and there are resulting cost reducing advantages.

The compressor of an exhaust-gas turbocharger can be located close to the inlet openings of the cylinders, such that a desirable response behavior of the internal combustion engine is achieved. The volume of the line system between the inlet openings of the cylinders and the compressor is further reduced.

A multiplicity of additional lines, for example the bypass line of a charge-air cooler, the bypass line of a compressor or the recirculation line of an external exhaust-gas recirculation arrangement, may open into the intake system or the overall intake line.

Exhaust-gas recirculation, that is to say the recirculation of combustion gases from the exhaust-gas discharge system into the intake system, is a concept for reducing nitrogen oxide emissions, wherein it is possible for the nitrogen oxide emissions to be considerably reduced with increasing exhaust-gas recirculation rate. If exhaust gas is recirculated, the combustion air comprises not only fresh air but also exhaust gas.

Embodiments of the direct-injection internal combustion engine may however nevertheless also be advantageous in which the intake lines merge to form an overall intake line outside the cylinder head.

Embodiments of the direct-injection internal combustion engine are advantageous in which the inlet valves and the outlet valves are spaced apart from one another in an in-line arrangement along an axis of the cylinder head which runs parallel to the axis of rotation of the crankshaft. The longitudinal axis of the cylinder head is a specific axis, runs parallel to the axis of rotation of the crankshaft, and is distinguished, in relation to other axes of the cylinder head, by the fact that it intersects the cylinder longitudinal axes.

The two cylinder-specific valves are arranged not opposite one another pairwise on different sides of the crankshaft, but rather along the crankshaft. All of the valves of the cylinder head according to the above embodiment are arranged one behind the other along an axis or the longitudinal axis of the cylinder head and thus in the direction of the crankshaft. Here, the valves are lined up along an axis which runs parallel to the longitudinal axis of the crankshaft and which also constitutes the axis of rotation of the crankshaft.

This structural feature forms the basis for an inexpensive concept. Here, the inlet valve and the outlet valve of a cylinder may basically be actuated by a common single camshaft, in one example.

The valves arranged one behind the other in a row in the direction of the crankshaft make it possible, despite the constricted space conditions in the cylinder head, for the intake line which leads to an inlet opening to be provided with a form which permits (e.g., ensures) the formation of a charge movement when the inlet opening is open during the course of a charge exchange. As already mentioned, the arrangement and the geometry of the intake line have a significant influence on the charge movement in the cylinder.

For the reasons stated above, embodiments of the direct-injection internal combustion engine are advantageous in which a common camshaft is provided for actuating the inlet valves and the outlet valves.

In this context, embodiments of the direct-injection internal combustion engine are advantageous in which the common camshaft is arranged eccentrically and at the outlet side and is mounted on the cylinder head.

This concept generally leads to longer intake lines and shorter exhaust-gas lines, but also to an improved charge exchange and thus to a greater power output, because the through flow behavior of the inlet opening is less sensitive with regard to an inclined arrangement of the inlet valve relative to the intake line than is the case for the exhaust-gas line and the associated outlet valve. In this context, it may be taken into consideration that the intake line is designed with regard to the charge movement in the cylinder, so as to have a spiral-shaped configuration, and the exhaust-gas line may be of more rectilinear form. However, other intake and exhaust gas lines contours have been contemplated.

Embodiments of the direct-injection internal combustion engine may however also be advantageous in which the common camshaft is arranged eccentrically and at the inlet side and is mounted on the cylinder head.

Although the common camshaft is preferably mounted in the cylinder head, it may basically also be mounted in a separate camshaft carrier unit, in some embodiments.

Here, embodiments of the direct-injection internal combustion engine are advantageous in which the inlet valves and the outlet valves are inclined relative to the associated cylinder longitudinal axis.

Embodiments of the direct-injection internal combustion engine are advantageous in which the cylinder head is equipped with at least one coolant jacket in order to form a liquid-type cooling arrangement.

FIG. 1 shows, in plan view, the intake lines 4 and the exhaust-gas lines 8 of a first embodiment of a cylinder head 1, which comprises three cylinders 3, of the direct-injection internal combustion engine 100.

The cylinder head 1 has three cylinders 3 which are arranged along the longitudinal axis 2 of the cylinder head 1 or along a parallel 2 to the cylinder head longitudinal axis, that is to say in an in-line arrangement, and thus has two outer cylinders $\mathbf{3}a_1$, $\mathbf{3}a_2$ and one inner cylinder 3*b*.

Proceeding from the front face side 5 of the cylinder head 1, the first cylinder 3 forms the first outer cylinder $\mathbf{3}a_1$, the second cylinder 3 forms the inner cylinder 3*b*, and the third cylinder 3 forms the second outer cylinder $\mathbf{3}a_2$, if the cylinders 3 are numbered consecutively from one to three.

Each cylinder 3 has one inlet opening for the supply of combustion air via an intake system, each inlet opening being adjoined by an intake line 4 (e.g., intake runner). The intake lines 4 of the cylinders 3 merge to form an overall intake line 6, thus forming an intake manifold 7. The intake manifold 7 is of asymmetrical form, specifically such that the overall intake line 6 is arranged eccentrically with respect to the manifold 7. The intake lines 4 combine at a merged intake line section 101. It will be understood that the merged intake line section 101 may be coupled to upstream components such as an intake conduit, a compressor, etc. A flange in the merged intake line section 101 may be used to achieve the attachment between the line section and upstream intake system components. The intake manifold 7 is asymmetric about a lateral plane 109 of the engine 100. The lateral plane 109 extends through a central axis 111 of a central cylinder in the plurality of cylinders. Thus, the merged intake line section 101 is offset with regard to the lateral plane 109. Offsetting the merged intake line section 101 allows the compactness of the engine to be increased by allowing a generator 118 to be packaged between a front end 130 of the engine 100 and the merged intake line section 101. Furthermore, by offsetting the merged intake line section 101 a common generator can be used in the engine 100 shown in FIG. 1 as well as the engine 200 shown in FIG. 2, by allowing a distance 132 between the connection point between a first side 134 of the generator 118 and a traction drive mechanism 116 and a second side 136 of the generator to be maintained in each engine arrangement. Consequently, production cost of both engines can be reduced by leveraging scaling efficiency gains, if desired, thereby reducing vehicle costs.

The intake lines 4 of the three cylinders 3 merge to form the overall intake line 6 centrally between the inner cylinder 3*b*, that is to say the second cylinder 3, and the second outer cylinder 3*a*2, that is to say the third cylinder 3.

The intake lines 4 of the inner cylinder 3*b* and of the second outer cylinder 3*a*2 between which the overall intake line 6 is arranged centrally are of symmetrical form with respect to a central plane S which runs centrally between the two cylinders 3*a*2, 3*b* and which is perpendicular to the longitudinal axis 2 of the cylinder head 1.

For the discharge of the exhaust gases via an exhaust-gas discharge system, each cylinder 3 is equipped with an outlet opening, which is adjoined by in each case one exhaust-gas line 8.

FIG. 1 also shows a camshaft 102 with cams 104 designed to actuated intake valves 106 and exhaust valves 108. The intake valves are designed to open and close to permit and inhibit intake airflow into the cylinder from the intake lines 4. To achieve this functionality the valves may include stems, heads, etc. The exhaust valves are designed to open and close to permit and inhibit exhaust gas flow from the cylinders to the exhaust-gas lines 8. The camshaft 102 is arranged along a longitudinal axis 105 of the engine 100. The longitudinal axis is parallel to a rotational axis of a crankshaft 110. The longitudinal axis 105 also extends through central axes 107 of each of the cylinders.

The crankshaft 110 receives rotational energy from the cylinders 3. Mechanical components such as pistons, piston rods, etc., are used to achieve the rotational energy transfer from the cylinders to the crankshaft 110. A transmission interface 112 (e.g., flywheel) is also shown in FIG. 1. The transmission interface 112 is designed to transfer rotational energy to a transmission. In some examples, the transmission interface 112 may store energy generated by the engine to aid in smoother engine operation and shifting operation. However, the transmission interface may have additional or alternate functions such as rotational speed adjustment through the use of gearing.

Injection nozzles 114 are also shown in FIG. 1. The injection nozzles 114 are included in fuel injectors. The fuel injectors receive fuel from a fuel delivery system (not shown) which may include storage tanks, fuel lines, returns lines, valves, pumps, etc., designed to provide fuel to the injectors. The injectors are shown directly coupled to the cylinders to provide what is known in the art as direct injection. Additionally or alternatively the fuel delivery system may provide port fuel injection where fuel is delivered into intake lines upstream of the intake valves. As shown, each of the injection nozzles 114 are aligned with the central axes 107 of the cylinders 3.

FIG. 1 also shows a traction drive mechanism 116 (e.g., front end accessory drive system). The traction drive mechanism 116 is configured to deliver kinetic energy (e.g., rotational energy) to a plurality of components (e.g., accessory components) as well as a generator 118 and the camshaft 102. Suitable mechanisms such as belts, chains, gears, combinations thereof, etc., may be used to distribute the rotational energy from the traction drive mechanism 116 to the various components.

The generator 118 (e.g., alternator) receives rotational energy from the traction drive mechanism 116, indicated via arrow 120. The generator 118 is configured to convert rotational energy to electrical energy and therefore may include stators, rotors, drive shafts, etc., to accomplish said energy transformation. The generator 118 may be electrically connected to various components in the engine and/or vehicle utilizing electrical energy. Additionally, the generator 118 may also supply energy to an energy storage device (e.g., battery). Arrow 122 indicates the transfer of energy from the traction drive mechanism 116 to the camshaft 102.

Figure 2:
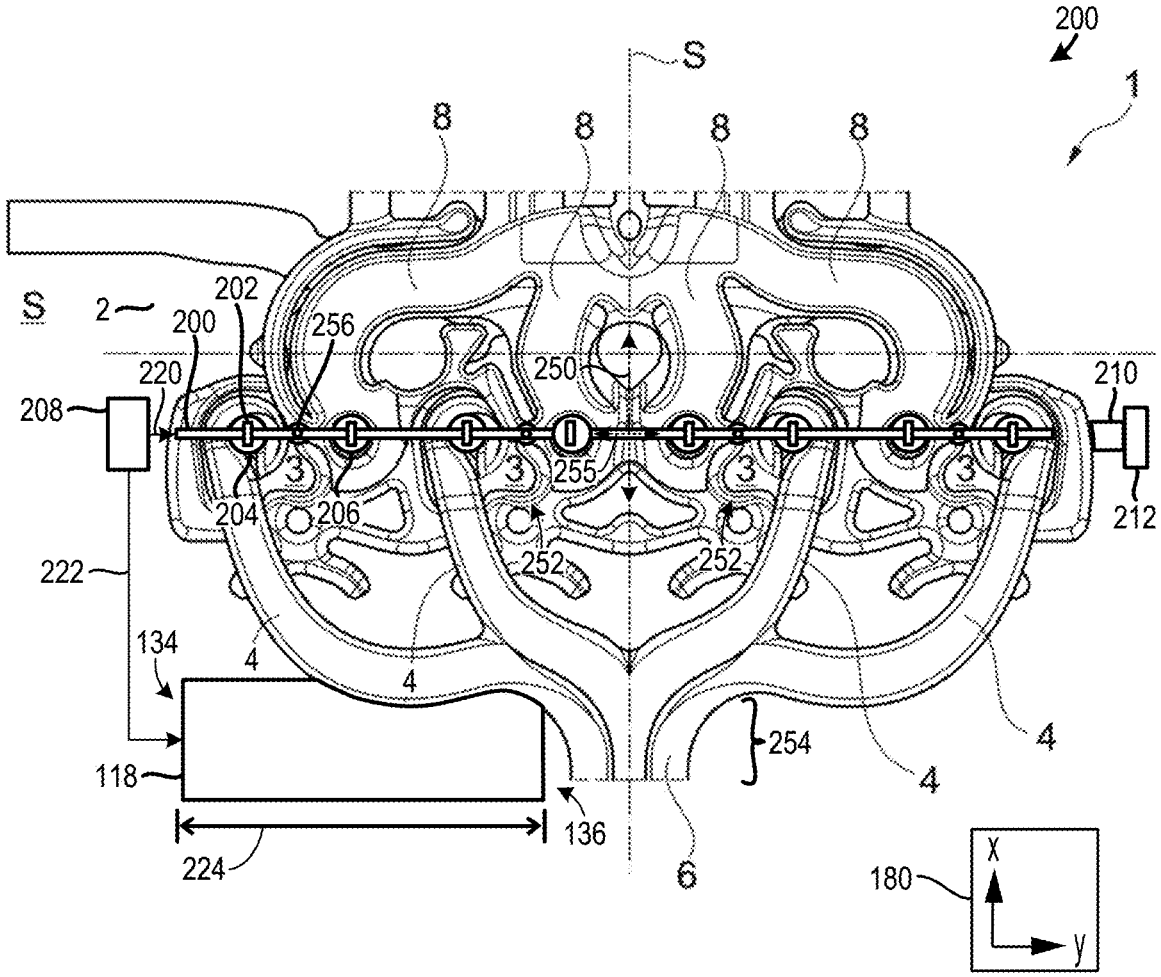
FIG. 2 shows, in plan view, the intake lines and the exhaust-gas lines of a second embodiment of a cylinder head, which comprises four cylinders, of the direct-injection internal combustion engine.

FIG. 2 also includes a camshaft, crankshaft, a transmission interface, generator, traction drive mechanism, and injection nozzles, similar to FIG. 1. Redundant description is omitted for brevity.

An axis system 180 is shown in FIG. 1 as well FIGS. 2-6 to establish a common frame of reference among the figures. In one example, the z-axis may be parallel to a gravitational axis, the x-axis may be a lateral axis and the y-axis may be a longitudinal axis. However, other orientations of the axes may be used, in other examples.

FIG. 1 also illustrates a controller 150. Specifically, controller 150 is shown in FIG. 1 as a conventional microcomputer including: microprocessor unit 151, input/output ports 152, read-only memory 153, random access memory 154, keep alive memory 155, and a conventional data bus. Controller 150 is configured to receive various signals from sensors coupled to the engine 100. The sensors may include exhaust gas composition sensor (not shown), exhaust gas airflow sensor (not shown), an intake airflow sensor (not shown), manifold pressure sensor (not shown), engine speed sensor (not shown), etc. Additionally, the controller 150 is also configured to receive pedal position from a pedal position sensor 162 coupled to a pedal 160 actuated by an operator 164.

Additionally, the controller 150 may be configured to trigger one or more actuators and/or send commands to components. For instance, the controller 150 may trigger adjustment of a throttle valve (not shown), fuel injectors, etc. Specifically in one example, the controller 150 may send signals to an actuator in the throttle to induce throttle plate adjustment. In this way, the controller 150 may send control signals to the throttle to vary engine speed. The other adjustable components receiving commands from the controller may also function in a similar manner. Therefore, the controller 150 receives signals from the various sensors and employs the various actuators to adjust engine operation based on the received signals and instructions stored in memory (e.g., non-transitory memory) of the controller.

FIG. 2 shows, in plan view, the intake lines 4 and the exhaust-gas lines 8 of a second embodiment of a cylinder head 1, which comprises four cylinders 3, of a second example of a direct-injection internal combustion engine 200. It is sought merely to explain the additional features in relation to FIG. 1, for which reason reference is made otherwise to FIG. 1 and the associated description. The same reference designations have been used for the same components.

The intake manifold 7 is of symmetrical form such that the overall intake line 6 is arranged centrally with respect to the manifold 7. The intake lines 4 of the four cylinders 3 merge centrally between the two inner cylinders 3, that is to say between the second cylinder 3 and the third cylinder 3. This gives rise to a common feature with respect to the intake manifold 7 illustrated in FIG. 1, specifically with regard to the arrangement of the overall intake line 6. To elaborate, the intake manifold 7, shown in FIG. 2 is symmetric about a lateral plane 250 extending between a pair of inner cylinders 252 included in the plurality of cylinders 3. Specifically, a merged intake line section 254 at the confluence of the exhaust lines 4 is arranged symmetrically with regard to the lateral plane 250.

The illustrated intake manifold 7 of a four-cylinder in-line engine also depicts the starting point for the structural design of the embodiment as per FIG. 1.

This is beneficial in achieving the aim, in the structural design of an intake system, of creating a large number (e.g., the greatest possible number) of common features within an engine family that comprises cylinder heads 1 with different numbers of cylinders 3.

Proceeding from the intake manifold 7 of a four-cylinder in-line engine as illustrated in FIG. 2, the intake line 4 of the fourth cylinder 3 has been omitted in order to arrive at the intake manifold 7 of FIG. 1.

It can also be seen that the intake lines 4 are longer than the exhaust-gas lines 8.

FIG. 2 shows a camshaft 200 including cams 202 designed to actuate intake valves 204 and exhaust valves 206. In the illustrated example, a common camshaft actuates both the intake and exhaust valves. However, in other examples separate camshafts may actuate the intake valves and the exhaust valves. In such an example, the camshafts may be laterally offset from a longitudinal axis 255 extending through the central axes 256 of each cylinder.

FIG. 2 also shows a traction drive mechanism 208 (e.g., front end accessory drive system). The traction drive mechanism 208 is configured to deliver kinetic energy (e.g., rotational energy) to a plurality of components (e.g., accessory components) as well as the generator 118 and the camshaft 200. Specifically, arrow 220 indicates the transfer of energy from the traction drive mechanism 208 to the camshaft 200 and arrow 222 indicates the transfer of energy from the traction drive mechanism 208 to the generator 118. Suitable mechanisms such as belts, chains, etc., may be used to distribute the rotational energy from the traction drive mechanism 208 to the various components. A distance 224 between the connection point between a first side 134 of the generator 118 and the traction drive mechanism 208 and a second side 136 of the generator is indicated in FIG. 2. It will be understood that the distance 224 shown in FIG. 2 is substantially equivalent to the distance 132, shown in FIG. 1. A crankshaft 210 and a transmission interface 212 are also illustrated in FIG. 2.

Figure 3:
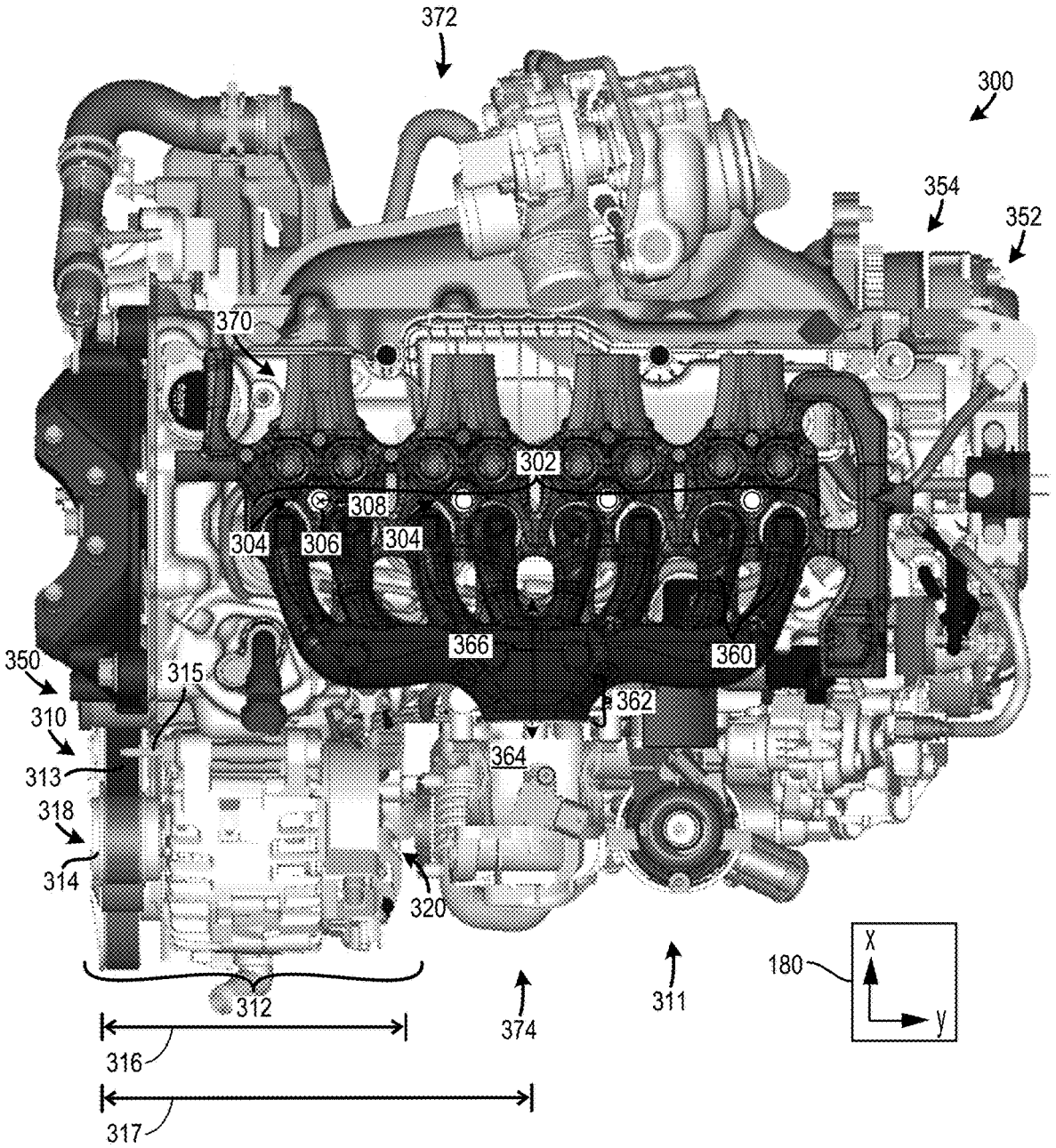
FIG. 3 shows another example of an engine including an intake manifold and a front end accessory drive system.

FIG. 3 shows another example of an engine 300. The engine 300 shown in FIG. 3 includes an intake manifold 302. The intake manifold 302 provides intake air to cylinders 304. Specifically, the engine 300 includes intake valves that may be similar in function to the other intake valves described herein. The engine 300 also includes fuel injectors 306. The fuel injectors 306 are direct fuel injectors, in the illustrated example. However, port injectors may additionally or alternatively be included in the fuel delivery system. The fuel injectors 306 are centrally arranged with regard to the cylinder. To elaborate, the injectors are aligned with central axes 308 of their respective cylinder. However, off-axis injector arrangements have been envisioned.

The intake manifold 302 includes runners 360 joining at a merged intake line section 362. The runners are coupled to the intake valves of each cylinder and the merged intake line section is coupled to upstream components such as a throttle, compressor, air filter, etc. The merged intake line section 362 is coupled to an upstream intake conduit 364 and is in fluidic communication with upstream intake system components such as a throttle, filter etc. The intake manifold 302 is symmetric about a lateral plane 366, in the illustrated example. Designing the manifold with a symmetric arrangement may enable a targeted air flow pattern in the intake system to be achieved.

The engine 300 further includes a front end accessory drive system 310 receiving rotational energy from pistons in the cylinders 304 and delivering energy (e.g., rotational energy) to accessory components 311 (e.g., air conditioning (AC) compressor, fuel pump, oil pump, etc.,) and a generator 312. The front end accessory drive system 310 is on the front side 350 of the engine 300. A rear side 352 of the engine 300 is also indicated in FIG. 3. A transmission interface 354 (e.g., flywheel) may be positioned on the rear side of the engine.

A belt 313 designed to transfer energy between components is coupled to the front end accessory drive system 310, the accessory components 311, and the generator 312 is also shown in FIG. 3. However, other suitable mechanisms (e.g., chains, gears, etc.,) designed to transfer rotational energy from the front end accessory drive system and accessory components and/or generator. An attachment mechanism 315 (e.g., bolt and nut) is also shown attaching the generator 312 to the engine 300.

The generator 312 is designed to generate electrical energy from the rotational input and deliver the electrical energy to components such as an energy storage device (e.g., battery), electrical components, etc. The generator 312 includes an input interface 314 coupled to the belt 313. The input interface 314 may be connected to a shaft. The generator 312 also may include other components for electricity generation such as rotors, stators, etc.

A distance 316 between a first side 318 (e.g., front side) of the generator 312 and a rear side 320 of the generator, is indicated in FIG. 3. A distance 317 between the first side 318 of the generator 312 and a center of the merged intake line section 362, is also shown in FIG. 3.

The generator 312 is shown extending longitudinally from the front side 350 of the engine 300 to a location spaced away from the merged intake line section 362. Additionally, the merged intake line section 362 is shown positioned longitudinally between the transmission interface 354 and the generator 312. In this way, efficient engine packaging may be achieved. FIG. 3 also shows an exhaust manifold 370 in the engine on a first lateral side 372 of the engine 300. The generator 312 is positioned on a second lateral side 374 of the engine 300 opposing the first lateral side 372. It will be appreciated that the exhaust manifold receives exhaust gas from exhaust valves coupled to the cylinders 304. However, other engine component arrangements may be used, in other examples.

Figure 4:
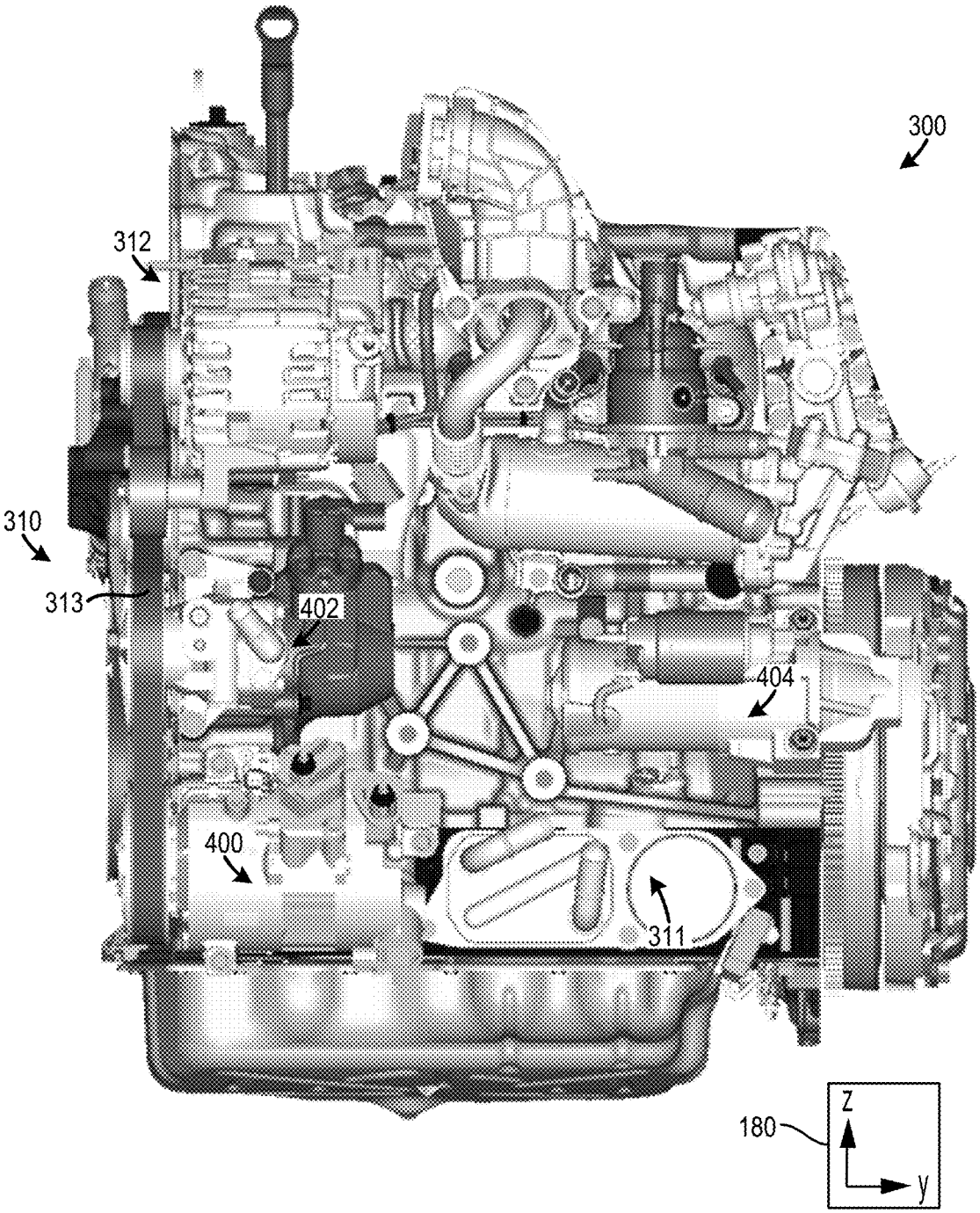
FIG. 4 shows a side view of the engine, depicted in FIG. 3.

FIG. 4 shows a side view of the engine 300. The accessory components 311 are again illustrated, which include an air conditioning (AC) compressor 400, a fuel pump 402, and a starter motor 404. The fuel pump 402 is positioned vertically below the generator 312 and the compressor 400 is positioned below the fuel pump. However, other accessory component arrangements have been envisioned. The belt 313 coupling the accessory components 311 to the front end accessory drive system 310 is also shown in FIG. 4.

Figure 5:
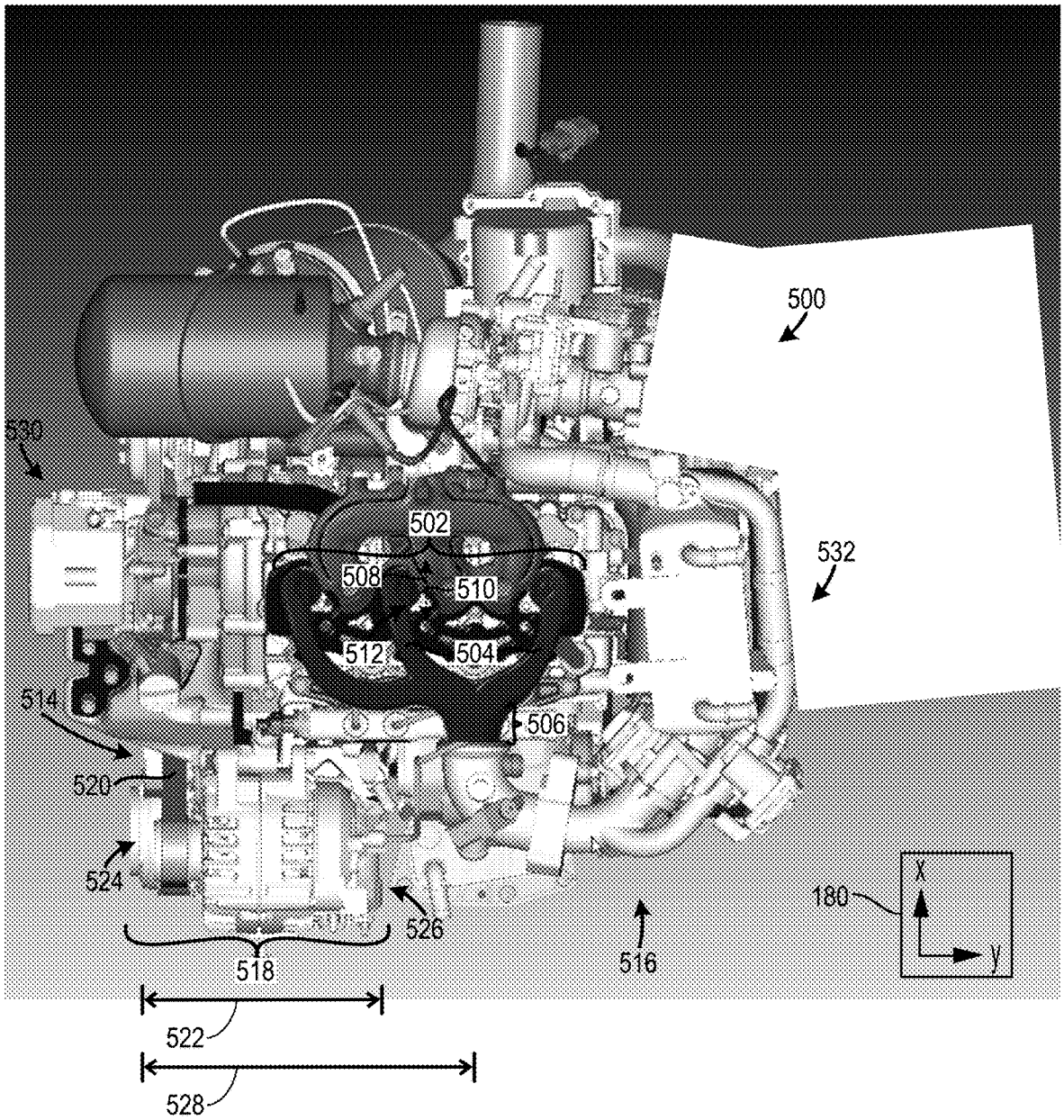
FIG. 5 shows another example of an engine including an intake manifold and front end accessory drive system.

FIG. 5 shows an engine 500 with an intake manifold 502. The intake manifold 502 includes runners 504. The confluence of the runners 504 is a merged intake line section 506. The runners 504 are arranged asymmetrically with regard to a lateral plane 508 arranged perpendicular to a central axis 510 of a central cylinder 512.

A front end accessory drive system 514 is also included in the engine 500. The front end accessory drive system 514 is coupled to accessory components 516 and a generator 518 via a belt 520 and/or other suitable mechanism (e.g., chains, gears, etc.) Furthermore, the generator 518 is again shown extending from a front side 530 of the engine 500 towards a rear side 532 of the engine 500.

A distance 522 between a first side 524 of the generator 518 and a second side 526 of the generator is also shown in FIG. 5. It will be understood that the generator 518 shown in FIG. 5 may be substantially similar in profile and function to the generator 312, shown in FIG. 3. As such, the distance 522, shown in FIG. 5 is substantially equivalent to the distance 316, shown in FIG. 3. Additionally, a distance 528 between the first side 524 of the generator 518 and a center of the merged intake line section 506, is also shown in FIG. 5. The distance 528, shown in FIG. 5, may be substantially equivalent to the distance 317, shown in FIG. 3. When a similar generator is used in both of the engine 300, shown in FIG. 3, and the engine 500, shown in FIG. 5, and mounted in a similar manner and location the production costs of an engine line including both engines is reduced. In other words, scaling efficiency gains can be achieved when a common generator is used in the manufacture of two different engines in an engine line.

Figure 6:
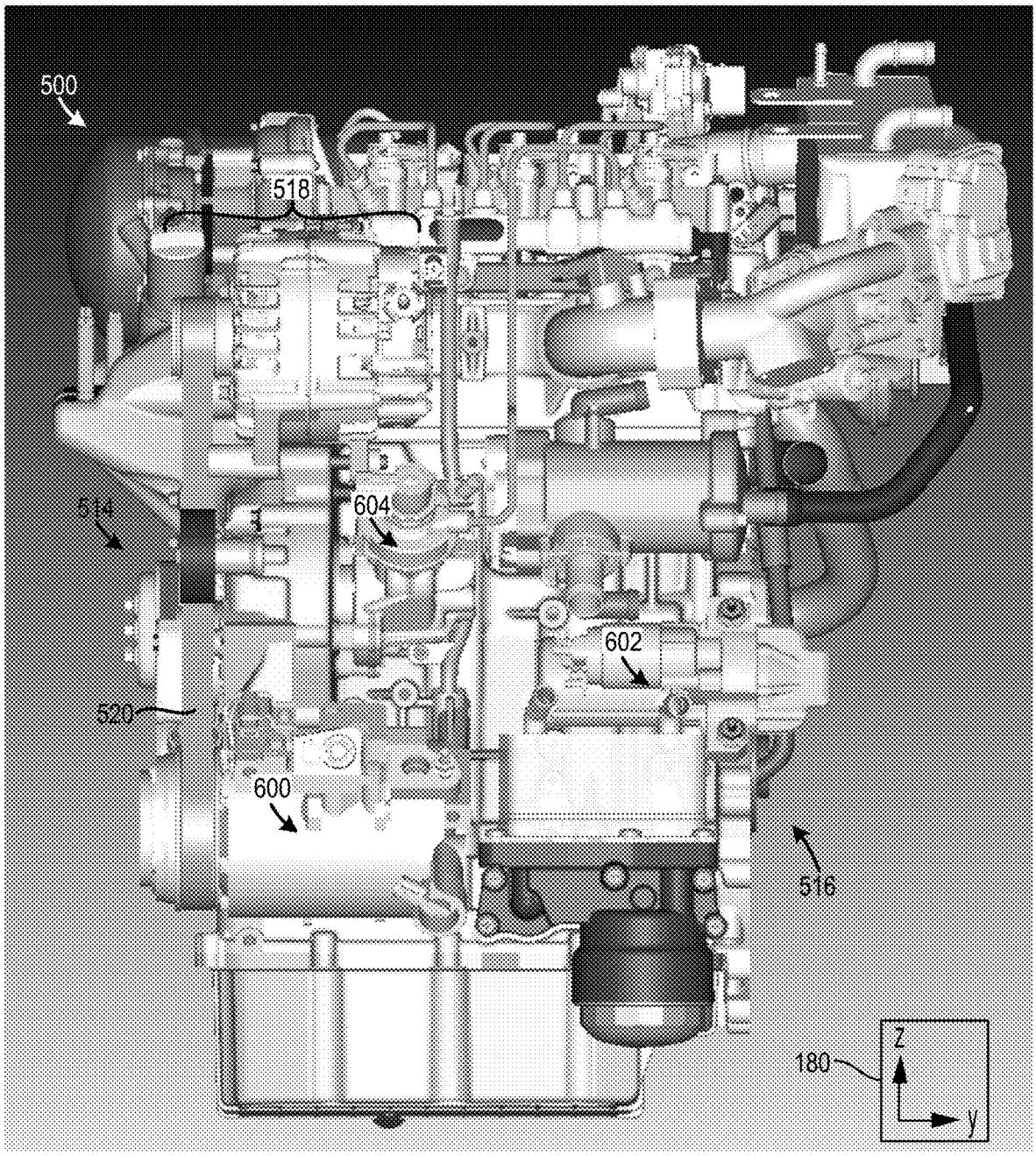
FIG. 6 shows a side view of the engine illustrated in FIG. 5.

FIG. 6 shows a side view of the engine 500. The front end accessory drive system 514 is again shown along with the accessory components 516 and the generator 518 as well as the belt 520. The accessory components 516 include an AC compressor 600, a starter motor 602, and a fuel pump 604.

It will be understood that two or more of the engines described herein may be included in an engine line. For example, engine 300, shown in FIG. 3, and engine 500, shown in FIG. 5, may be included in an engine line. In another example, engine 100, shown in FIG. 1, and engine 200 shown in FIG. 2, may be included in another engine line. It will also be understood that structural and/or functional features in one of the engine embodiments described herein may be combined with structural and/or functional features in other engine embodiments described herein to form an engine with other combinations of structural and functional characteristics.

FIGS. 1-6 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

It will be appreciated that one or more components referred to as being "substantially similar and/or identical" differ from one another according to manufacturing tolerances (e.g., within 1-5% deviation). Furthermore, as describe herein "approximately" and "substantially" refers to a deviation by 5% or less, unless otherwise noted.

The invention will be further described in the following paragraphs. In one aspect, an engine line is provided that comprises: a first engine including a front end accessory drive system; a second engine including a greater number of cylinders than the first engine and a front end accessory drive system; and a generator, in different manufacturing arrangements, mounting to each of the front engine accessory drive systems in the first and second engines in a common location.

In another aspect, an engine line is provided that comprises: a first engine comprising: a plurality of cylinders; and an intake manifold having a merged intake line section and a plurality of runners providing intake air to the plurality of cylinders; a second engine comprising: a plurality of cylinders, where the first and second engines have an unequal number of cylinders; and an intake manifold having a merged intake line section and a plurality of runners providing intake air to the plurality of cylinders; a generator designed to mount in each of the first engine and the second engine in a location longitudinally offset from the merged intake line section in the respective engine and designed to receive rotational energy from the respective engine.

In any of the aspects or combinations of the aspects, first engine may include a plurality of cylinders with a plurality of intake runners coupled to the plurality of cylinders and combining at a merged intake line section, where the merged intake line section is offset from a lateral plane extending through a centerline of a middle cylinder included in the plurality of cylinders; and where the second engine may include a plurality of cylinders with a plurality of intake runners coupled to the plurality of cylinders and combining at a merged intake line section, where the merged intake line section is symmetric about a lateral plane extending between a pair of inner cylinders included in the plurality of cylinders.

In any of the aspects or combinations of the aspects, when the generator is mounted in the different manufacturing arrangements, the generator may extend an equivalent longitudinal distance from a front end of each of the first engine and the second engine.

In any of the aspects or combinations of the aspects, the generator may be designed to couple to a front end accessory drive system on a front side of each of the first and second engines and where the first and second engines may each include a transmission interface on a rear side and where each of the merged intake line sections are positioned longitudinally between the transmission interface and the generator.

In any of the aspects or combinations of the aspects, the first engine may include intake and exhaust valves arranged along a longitudinal axis extending through a central axis of each of the plurality of cylinders and where the second engine may include intake and exhaust valves offset from a longitudinal axis extending through a central axis of each of the plurality of cylinders in the second engine.

In any of the aspects or combinations of the aspects, the first and second engines may each include an accessory component receiving rotational input from a front end accessory drive system, the generator receiving rotational input from the front end accessory drive system, and the accessory component positioned below the generator.

In any of the aspects or combinations of the aspects, a distance between a front side the first engine and the merged intake line section and a distance between a front side of the second engine and the merged intake line section may be substantially equivalent.

In any of the aspects or combinations of the aspects, the first engine may include an odd number of cylinders and the second engine may include an even number of cylinders.

In any of the aspects or combinations of the aspects, the cylinder head may be equipped with at least one coolant jacket in order to form a liquid-type cooling arrangement.

In any of the aspects or combinations of the aspects, firstly the intake line of a first outer cylinder and the intake line of the inner cylinder may merge, before these jointly merge with the intake line of a second outer cylinder to form the overall intake line.

In any of the aspects or combinations of the aspects, the intake lines of the cylinders may merge to form the overall intake line centrally between the inner cylinder and an outer cylinder.

In any of the aspects or combinations of the aspects, the cylinder head may comprise five cylinders, of which two cylinders are outer cylinders and one cylinder is a central cylinder, in each case one inner cylinder being arranged between the centrally situated cylinder and an outer cylinder.

In any of the aspects or combinations of the aspects, the intake lines of the cylinders may merge to form the overall intake line centrally between the central cylinder and an inner cylinder.

In any of the aspects or combinations of the aspects, the intake lines of the cylinders may merge to form the overall intake line centrally between the central cylinder and an inner cylinder which is adjacent to the first outer cylinder.

In any of the aspects or combinations of the aspects, the inlet valves and the outlet valves may be inclined relative to the associated cylinder longitudinal axis.

In any of the aspects or combinations of the aspects, the intake lines of the cylinders may merge to form the overall intake line centrally between the inner cylinder and a second outer cylinder.

In any of the aspects or combinations of the aspects, the intake lines of the inner cylinder and of the outer cylinder between which the overall intake line is arranged centrally may be of symmetrical form, specifically with respect to a central plane S which runs centrally between the two cylinders and which is perpendicular to the longitudinal axis of the cylinder head.

In another representation, an engine line is provided that includes a first engine having a intake manifold with a plurality of symmetrically arranged runners and a second engine having an intake manifold with a plurality of non-symmetrically arranged runners with a generator positioned between a front end of the engine and a merged intake line at a confluence of the non-symmetrically arranged runners.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A direct-injection internal combustion engine comprising:

a cylinder head having at least three cylinders in an in-line arrangement along a longitudinal axis of the cylinder head;

where each cylinder has an inlet opening for the supply of combustion air into the cylinder via an intake system, each inlet opening being adjoined by an intake line, and the intake lines of the cylinders merging to form an overall intake line, thus forming an intake manifold;

where each cylinder has an outlet opening for discharging the exhaust gases via an exhaust-gas discharge system, each outlet opening being adjoined by an exhaust-gas line;

where each inlet opening is equipped with an inlet valve, and each outlet opening is equipped with an outlet valve;

where each cylinder comprises a piston articulatedly connected to a crankshaft;

where the piston oscillates along a cylinder longitudinal axis as the crankshaft rotates about an axis of rotation, the cylinder longitudinal axis being perpendicular to the axis of rotation of the crankshaft;

where each cylinder is equipped with an injection nozzle for the direct introduction of fuel into the cylinder; and where the cylinder-specific injection nozzle is arranged centrally, without a spacing to the cylinder longitudinal axis, and is oriented along the cylinder longitudinal axis;

where the intake lines combine at a merged intake line section within the cylinder head;

where the merged intake line section is arranged closer to a first outer cylinder than a second outer cylinder; and where the first and second outer cylinders are included in the at least three cylinders.

2. The direct-injection internal combustion engine as claimed in claim 1, where the cylinder head comprises three or five cylinders in an in-line arrangement, the intake manifold being of asymmetrical design such that the overall intake line is arranged eccentrically with respect to the manifold.

3. The direct-injection internal combustion engine as claimed in claim 1, where the cylinder head comprises three cylinders, of which two cylinders are outer cylinders and one cylinder is an inner cylinder which is arranged between the two outer cylinders.

4. The direct-injection internal combustion engine as claimed in claim 3, where, adjacent to a first outer cylinder, a traction drive mechanism is provided on a front face side of the cylinder head.

5. The direct-injection internal combustion engine as claimed in claim 4, where a generator is provided between the front face side of the cylinder head and the overall intake line.

6. The direct-injection internal combustion engine as claimed in claim 1, where the cylinder head comprises four cylinders in an in-line arrangement, the intake manifold being of symmetrical design such that the overall intake line is arranged centrally with respect to the manifold.

7. The direct-injection internal combustion engine as claimed in claim 1, where, adjacent to the first outer cylinder, a traction drive mechanism is provided on a front face side of the cylinder head.

8. The direct-injection internal combustion engine as claimed in claim 7, where the traction drive mechanism is a front end accessory drive system providing rotational energy to a generator and an accessory component.

9. The direct-injection internal combustion engine as claimed in claim 1, where the intake lines merge to form an asymmetric overall intake line within the cylinder head.

10. The direct-injection internal combustion engine as claimed in claim 1, where the inlet valves and the outlet valves are spaced apart from one another in an in-line arrangement along an axis of the cylinder head which runs parallel to the axis of rotation of the crankshaft.

11. The direct-injection internal combustion engine as claimed in claim 1, where a common camshaft is provided for actuating the inlet valves and the outlet valves.

12. An engine line comprising:

a first engine including a front end accessory drive system;

a second engine including a greater number of cylinders than the first engine and a front end accessory drive system; and a generator, in different manufacturing arrangements, mounting to each of the front engine accessory drive systems in the first and second engines in a common location.

13. The engine line of claim 12, where the first engine includes:

a plurality of cylinders with a plurality of intake runners coupled to the plurality of cylinders and combining at a merged intake line section, where the merged intake line section is offset from a lateral plane extending through a centerline of a middle cylinder included in the plurality of cylinders; and where the second engine includes:

a plurality of cylinders with a plurality of intake runners coupled to the plurality of cylinders and combining at a merged intake line section, where the merged intake line section is symmetric about a lateral plane extending between a pair of inner cylinders included in the plurality of cylinders.

14. The engine line of claim 12, where when the generator is mounted in the different manufacturing arrangements, the generator extends an equivalent longitudinal distance from a front end of each of the first engine and the second engine.

15. An engine line comprising:

a first engine comprising:

a plurality of cylinders; and an intake manifold having a merged intake line section and a plurality of runners providing intake air to the plurality of cylinders;

a second engine comprising:

a plurality of cylinders, where the first and second engines have an unequal number of cylinders; and an intake manifold having a merged intake line section and a plurality of runners providing intake air to the plurality of cylinders;

a generator designed to mount in each of the first engine and the second engine in a location longitudinally offset from the merged intake line section in the respective engine and designed to receive rotational energy from the respective engine.

16. The engine line of claim 15, where the generator is designed to couple to a front end accessory drive system on a front side of each of the first and second engines and where the first and second engines each include a transmission interface on a rear side and where each of the merged intake line sections are positioned longitudinally between the transmission interface and the generator.

17. The engine line of claim 15, where the first engine includes intake and exhaust valves arranged along a longitudinal axis extending through a central axis of each of the plurality of cylinders and where the second engine includes intake and exhaust valves offset from a longitudinal axis extending through a central axis of each of the plurality of cylinders in the second engine.

18. The engine line of claim 15, where the first and second engines each include an accessory component receiving rotational input from a front end accessory drive system, the generator receiving rotational input from the front end accessory drive system, and the accessory component positioned below the generator.

19. The engine line of claim 15, where a distance between a front side the first engine and the merged intake line section and a distance between a front side of the second engine and the merged intake line section is substantially equivalent.

20. The engine line of claim 15, where the first engine includes an odd number of cylinders and the second engine includes an even number of cylinders.

* * * * *